US008735042B2

(12) United States Patent
Kamiwaki et al.

(10) Patent No.: US 8,735,042 B2
(45) Date of Patent: May 27, 2014

(54) ELECTROSTATIC LATENT IMAGE DEVELOPING TONER, DEVELOPER, TONER CARTRIDGE, PROCESS CARTRIDGE, IMAGE FORMING METHOD, AND IMAGE FORMING APPARATUS

(75) Inventors: Satoshi Kamiwaki, Kanagawa (JP); Kiyohiro Yamanaka, Kanagawa (JP); Yusuke Ikeda, Kanagawa (JP); Koji Sasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 115 days.

(21) Appl. No.: 13/362,494

(22) Filed: Jan. 31, 2012

(65) Prior Publication Data

US 2013/0011774 A1 Jan. 10, 2013

(30) Foreign Application Priority Data

Jul. 5, 2011 (JP) ..... 2011-148956

(51) Int. Cl.
*G03G 9/00* (2006.01)

(52) U.S. Cl.
USPC ..... 430/123.53; 430/108.1; 430/109.1; 430/109.4; 430/123.54; 430/125.3

(58) Field of Classification Search
USPC ..... 430/108.1, 109.1, 109.4, 123.53, 430/123.54, 125.3
See application file for complete search history.

(56) References Cited

U.S. PATENT DOCUMENTS

2011/0123924 A1* 5/2011 Wosnick et al. ..... 430/124.23

FOREIGN PATENT DOCUMENTS

JP B2-4139643 6/2008

* cited by examiner

*Primary Examiner* — Thorl Chea
(74) *Attorney, Agent, or Firm* — Oliff PLC

(57) ABSTRACT

An electrostatic latent image developing toner includes: a release agent; a pigment; and a binder resin. The content of the pigment is from about 10% by weight to about 50% by weight, the glass transition temperature (Tg) of the toner is in the range of from about −60° C. to about 20° C., and the Young's modulus at 20° C. is in the range of from about $1\times10^{0}$ MPa to about $1\times10^{3}$ MPa.

14 Claims, 1 Drawing Sheet

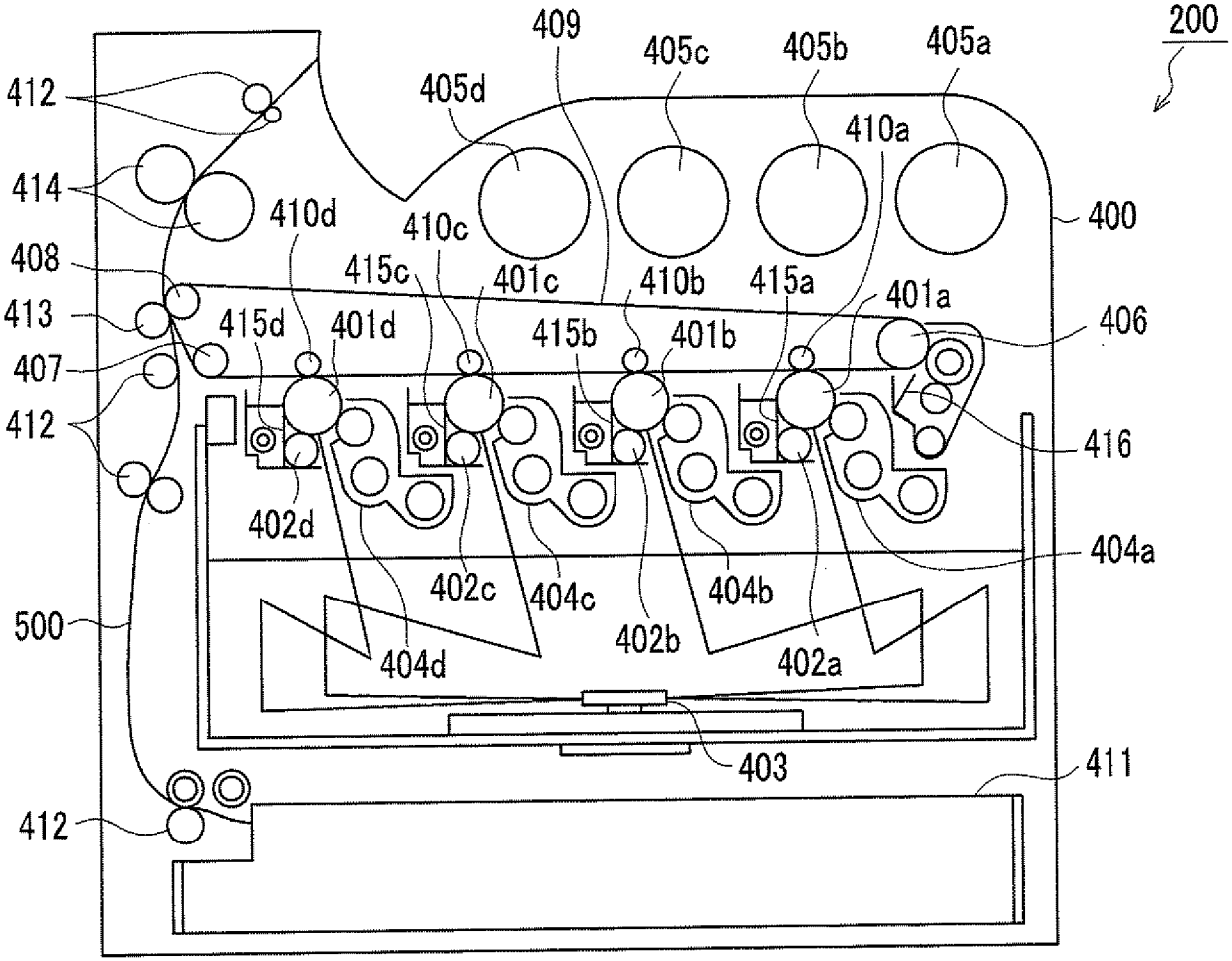
200
400
406
416
404a
411
405a
410a
401a
405b
415a
402a
404b
403
405c
410b
401b
402b
409
415b
404c
405d
401c
402c
410c
415c
404d
401d
410d
402d
415d
412
414
408
413
407
412
500
412

ELECTROSTATIC LATENT IMAGE DEVELOPING TONER, DEVELOPER, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2011-148956 filed Jul. 5, 2011.

BACKGROUND

1. Technical Field

The present invention relates to an electrostatic latent image developing toner, a developer, a toner cartridge, a process cartridge, an image forming method, and an image forming apparatus.

2. Related Art

Currently, methods of visualizing image information through an electrostatic latent image, such as electrophotography, are used in various fields. In electrophotography, an electrostatic latent image is formed on a photoreceptor by charging and exposing processes and is developed by a developer including a toner, and the developed image is visualized through transferring and fixing processes.

As an electrostatic latent image developing toner having various functions, there is a toner by which a formed image has peelability. The image that is formed by such an electrostatic latent image developing toner may be peeled after use, and thus the image may be, for example, removed.

In addition, when the peelable electrostatic latent image developing toner also has concealing ability, the image that is formed by such an electrostatic latent image developing toner may be used as a concealing layer and a scratch concealing material may be prepared.

SUMMARY

According to an aspect of the invention, there is provided an electrostatic latent image developing toner includes: a release agent; a pigment; and a binder resin, in which the content of the pigment is from about 10% by weight to about 50% by weight, a glass transition temperature (Tg) of the toner is in the range of from about −60° C. to about 20° C., and Young's modulus at 20° C. is in the range of from about 1×10° MPa to about $1\times10^3$ MPa.

BRIEF DESCRIPTION OF THE DRAWINGS

Exemplary embodiments of the present invention will be described in detail based on the following figures, wherein:

FIG. 1 is a schematic cross-sectional view showing an example of an image forming apparatus using a two-component developer according to an exemplary embodiment.

DETAILED DESCRIPTION

Hereinafter, an exemplary embodiment will be described in detail.

In this exemplary embodiment, "from A to B" represents a range including not only a range between A and B, but also A and B at both ends of the range. For example, when "from A to B" is a numerical range, it represents "equal to or greater than A and equal to or less than B", or "equal to or greater than B and equal to or less than A" in accordance with the sizes of the numerical values.

(Electrostatic Latent Image Developing Toner)

An electrostatic latent image developing toner (hereinafter, simply referred to as "toner" in some cases) according to this exemplary embodiment contains a release agent, a pigment, and a binder resin. The pigment content is from 10% by weight to 50% by weight (or from about 10% by weight to about 50% by weight), the glass transition temperature (Tg) is from −60° C. to 20° C. (or from about −60° C. to about 20° C.), and Young's modulus at 20° C. is from $1\times10^0$ MPa to $1\times10^3$ MPa (or from about $1\times10^0$ MPa to about $1\times10^3$ MPa).

The toner according to this exemplary embodiment is appropriately used in applications requiring peelability and concealing ability, and particularly, is appropriately used in preparation of a concealing layer such as a scratch sheet. The peelability means peeling from a concealing layer such as a scratch sheet by an appropriate force, and the concealing ability means durability such as resistance to a shock to the concealing layer such as a scratch sheet and difficulty in reading of letters from a concealing layer such as a scratch sheet.

The glass transition temperature (Tg) of the electrostatic latent image developing toner according to this exemplary embodiment is from −60° C. to 20° C. When the glass transition temperature is lower than −60° C., the strength of the toner is insufficient and the toner is easily peeled by only a small shock. Therefore, the concealing ability deteriorates. When the glass transition temperature is higher than 20° C., the peelability of the image deteriorates.

The glass transition temperature of the toner is preferably from −50° C. to 10° C., more preferably from −40° C. to 0° C., and even more preferably from −20° C. to −5° C. Since excellent peelability and concealing ability are obtained, it is desirable that the glass transition temperature of the toner be in the above range.

In this exemplary embodiment, the glass transition temperature of the toner is determined by a differential scanning calorimeter (DSC) measurement method, and is obtained by a main peak that is measured in accordance with ASTMD 3418-8.

In addition, in this exemplary embodiment, the glass transition temperature of the electrostatic latent image developing toner is defined. However, when the toner contains an external additive, there is no substantial difference in the glass transition temperature between before and after the addition of the external additive, and the glass transition temperature may be approximated by a value measured before the addition of the external additive.

The Young's modulus of the electrostatic latent image developing toner according to this exemplary embodiment at 20° C. is from $1\times10^0$ MPa to $1\times10^3$ MPa.

It is difficult to substantially prepare a toner of which the Young's modulus at 20° C. is less than $1\times10^0$ MPa since the more fluidity a resin other than the elastomer in the binder resin has, the lower the glass transition temperature. Therefore, when the closer Young's modulus to $1\times10^0$ MPa, the more the electrostatic property deteriorates and it becomes difficult to secure a developing amount. As a result, the concealing ability deteriorates. In addition, when the Young's modulus is greater than $1\times10^3$ MPa, the peelability of the image deteriorates.

The Young's modulus at 20° C. is preferably from $1\times10^{0.5}$ MPa to $1\times10^{2.5}$ MPa, and more preferably from $1\times10^{1.25}$ MPa to $1\times10^{1.75}$ MPa. Since scratch residue (peeling residue) are more suppressed from being scattered, it is desirable that the Young's modulus of the toner at 20° C. be in the above range.

In this exemplary embodiment, the Young's modulus of the toner at 20° C. means tensile elasticity measured in accordance with JIS K 7161-1994.

In addition, in this exemplary embodiment, the Young's modulus of the electrostatic latent image developing toner is defined. However, when the toner contains an external additive, there is no substantial difference in the Young's modulus between before and after the addition of the external additive, and the Young's modulus may be approximated by a value measured before the addition of the external additive.

In this exemplary embodiment, it is desirable that the glass transition temperature and the Young's modulus of the electrostatic latent image developing toner be adjusted in the above ranges, respectively, by selecting the kinds and characteristics of the release agent and/or the binder resin.

Hereinafter, the constituent components of the electrostatic latent image developing toner will be described in detail.

<Release Agent>

The electrostatic latent image developing toner according to this exemplary embodiment contains a release agent.

The release agent is not particularly limited. However, it is desirable to use a release agent realizing a good balance between peelability and abrasion resistance. As the release agent, there are nonreactive release agents and reactive release agents.

Examples of the nonreactive release agent include natural waxes such as beexwax, spermaceti, Japan wax, rice bran wax, carnauba wax, candelilla wax and montan wax; synthetic waxes such as paraffin wax, microcrystalline wax, oxidized wax, ozokerite, ceresin, ester wax and polyethylene wax; high-boiling point petroleum-based solvents such as aliphatic hydrocarbon and aromatic hydrocarbon; higher fatty acids such as margaric acid, lauric acid, myristic acid, palmitic acid, stearic acid, oleic acid, furoic acid and behenic acid; alcohols such as polyoxyalkylene glycols, glycols, polyoxyethylene higher alcohol ethers, stearyl alcohol and behenyl alcohol; fatty acid esters such as ethylene glycol fatty acid esters, sorbitol fatty acid esters and polyoxyethylene fatty acid esters; fatty acid amides such as a stearic acid amide and an oleic acid amide; phosphoric esters such as polyoxyalkylene phosphoric esters; metallic soaps such as calcium stearate and sodium oleate; fluorine resins such as PTFE, PFA, FEP, ETFE, PCTTE, ECTFE, PVDF and PVF; nonreactive silicone resins such as a dimethyl silicone resin, a methyl phenyl silicone resin, a diphenyl silicone resin, an alkyl-modified silicone resin, an aralkyl-modified silicone resin, an alkyl aralkyl-modified silicone resin, a fluorine-modified silicone resin and a polyoxyalkylene-modified silicone resin; inorganic release agents and the like.

The above-described nonreactive release agents are present in the binder resin without reacting to the binder resin in the toner, a part of the nonreactive release agent slightly bleeds (seeps) on the surface of the toner, and an excellent balance between peelability and abrasion resistance is realized. From such a viewpoint, natural waxes, synthetic waxes, high-boiling point petroleum-based solvents, nonreactive silicone resins and the like are preferably used. The boiling point of high-boiling point petroleum-based solvents is preferably 100° C. or higher, and more preferably 200° C. or higher.

In addition, as the reactive release agent, for example, there is a reactive silicone resin. Examples of the reactive silicone resin include an epoxy-modified silicone resin, an amino-modified silicone resin, a carboxyl-modified silicone resin, an alcohol-modified silicone resin, a mercapto-modified silicone resin, an epoxy polyether-modified silicone resin, a polyether-modified silicone resin, an acrylic-modified silicone resin and the like.

When reacting to the binder resin in the toner, these reactive silicone resins are fixed in the toner and an excellent balance between peelability and abrasion resistance is realized. From such a viewpoint, addition type silicone resins such as an epoxy-modified silicone resin, a mercapto-modified silicone resin and an acrylic-modified silicone resin are preferably used. For example, addition reaction of an epoxy group of an epoxy-modified silicone resin and a (meth)acryloyl group of an acrylic-modified silicone resin to the binder resin in the toner may occur.

Two or more kinds of release agents may be used in combination as necessary.

The melting temperature of these release agents is preferably from 50° C. to 100° C., and more preferably from 60° C. to 95° C. When the melting temperature of the release agent is in the above range, the toner has excellent peelability from a fixed member even when having properties according to this exemplary embodiment. The melting temperature is measured by differential scanning calorimetry according to ASTMD 3418-8 with reference to, for example, JP-R-2011-107328.

The content of the release agent in the toner is preferably from 0.5% by weight to 15% by weight, and more preferably from 1.0% by weight to 12% by weight. When the content of the release agent is 0.5% by weight or greater, peeling defects are prevented. When the content of the release agent is 15% by weight or less, a deterioration in fluidity of the toner is prevented, and thus reliability of the image quality and the image formation is maintained.

<Pigment>

In this exemplary embodiment, the electrostatic latent image developing toner contains a pigment.

The pigment is not particularly limited. However, it is desirable to use a pigment having concealing ability. Examples of such a pigment having concealing ability include metallic powders such as an aluminum powder, a brass powder, a copper powder, an iron powder, a silver powder, a gold powder and a platinum powder; clay minerals such as calcium carbonate, precipitated barium sulfate, a baryta powder, white carbon, silica, alumina white, aluminum hydroxide and kaolin clay; extender pigments such as talc, mica and nepheline-syenite; black pigments such as a colorant colored to black by mixing carbon black, a magnetic material, a yellow colorant, a magenta colorant and a cyan colorant; and white pigments such as titanium oxide, titaniuim white, zinc oxide, zinc white, zinc sulfide, lithopone, white lid, antimony white, zirconia and zirconia oxide.

The above-described pigments may be used singly, or plural kinds may be mixed and used in a solid or liquid state. These are selected in consideration of concealing ability, weather resistance, dispersibility in the toner and the like.

In addition, a colored pigment and a white pigment may be used singly, or with the pigment having the concealing ability.

Specific examples thereof include known pigments such as aniline black, aniline blue, calcoil blue, chrome yellow, ultramarine blue, Du Pont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, Pigment Yellow 97, C.I. Pigment Yellow 74, C.I. Pigment Blue 15:1 and C.I. Pigment Blue 15:3.

Among them, metallic pigments or black pigments, that are pigments having concealing ability, are preferably used, an aluminum powder or carbon black is more preferably used, and an aluminum powder is even more preferably used. By using these pigments, an image having excellent concealing ability is obtained.

The pigment content in the toner is from 10% by weight to 50% by weight. When the pigment content is less than 10% by weight, sufficient concealing ability may not be obtained. In addition, when the pigment content is greater than 50% by weight, the amounts of remaining components are reduced, and thus the fixability of the toner is reduced and peeling easily occurs, whereby an image having concealing ability may not be obtained.

The pigment content in the toner is preferably from 20% by weight to 40% by weight.

Since superior concealing ability is obtained and the toner is more easily produced, it is desirable that the pigment content be in the above range.

The pigment content in the toner is detected by the following method.

Specifically, a solvent is appropriately selected in accordance with the kinds of the binder resin and the release agent, and the binder resin and the release agent are dissolved therein to separate the pigment by a precipitation method to thereby measure the pigment content in the toner. The solvent is not particularly limited. One kind may be used singly, or two or more kinds may be combined. In addition, the dissolution of the binder resin and the release agent may be performed once, or a plural number of times while changing the solvent.

In this exemplary embodiment, the pigment content means the content with respect to the entire toner containing an external additive. However, in general, the addition amount of the external additive is smaller than that of toner mother particles, and thus it may be approximated by the content in the toner mother particles. In addition, it is desirable to remove the external additive by sieving or the like before the dissolution of the binder resin and the like.

<Binder Resin>

The electrostatic latent image developing toner according to this exemplary embodiment contains a binder resin.

In this exemplary embodiment, it is desirable to contain elastomers as the binder resin.

Examples of the elastomers include natural rubber-based elastomers such as natural rubber and chlorinated rubber; butadiene-based elastomers such as a butadiene polymer, a styrene-butadiene copolymer and acrylonitrile-butadiene copolymer; isoprene-based elastomers such as an isoprene polymer; a chloroprene polymer; nitrile rubber; acrylic rubber, and the like.

Among them, conjugated diene-based polymers such as butadiene-based elastomers and isoprene-based elastomers are preferably used, a butadiene-based polymer is more preferably used, and a styrene-butadiene copolymer is even more preferably used.

The glass transition temperature (Tg) of elastomers is preferably from −65° C. to −10° C. (or from about −65° C. to about −10° C.), more preferably from −55° C. to −20° C., and even more preferably from −55° C. to −30° C.

When the glass transition temperature is −65° C. or higher, compatibility with a resin other than the elastomer in the binder resin becomes better, and thus an encapsulation property of the pigment is improved and excellent concealing ability is obtained. In addition, when the glass transition temperature is −10° C. or lower, scattering is suppressed and excellent peelability is obtained.

The glass transition temperature of elastomers is measured in a manner similar to that for the above-described glass transition temperature of the toner.

The Young's modulus of elastomers at 20° C. or about 20° C. is preferably from $10^{-1}$ MPa to $10^{3}$ MPa (or from about $10^{-1}$ MPa to about $10^{3}$ MPa), more preferably from $10^{0}$ MPa to $10^{2.5}$ MPa, and even more preferably from $10^{0.5}$ MPa to $10^{2}$ MPa. Since sticking to a finger, a coin (causing peeling) and the like is suppressed and the concealing ability is thus improved, it is desirable that the Young's modulus at 20° C. or about 20° C. be $10^{-1}$ MPa or greater. In addition, since excellent peelability is obtained, it is desirable that the Young's modulus at 20° C. or about 20° C. be $10^{3}$ MPa or less.

The Young's modulus of elastomers is measured in a manner similar to that for the above-described Young's modulus of the toner.

The content of the elastomers in the binder resin in the electrostatic latent image developing toner is preferably from 40% by weight to 95% by weight (or from about 40% by weight to about 95% by weight) of the binder resin of the toner, more preferably from 50% by weight to 90% by weight, and even more preferably from 60% by weight to 80% by weight. When the content of the elastomers is 40% by weight or greater of the binder resin, the obtained image has excellent elasticity, and thus excellent peelability is obtained. When the content of the elastomers is 95% by weight or less, the sticky feeling of an image is improved, and as a result, image peeling due to rubbing is suppressed and excellent concealing ability is obtained.

In this exemplary embodiment, particularly, it is desirable to use conjugated diene-based polymers (diene-based emulsion-polymerized rubber), that are obtained by emulsion polymerization of a conjugate diene compound, as elastomers.

The emulsion polymerization may be performed by a common method. Examples of the emulsion-polymerized rubber include styrene-butadiene rubber (SBR) that is copolymer rubber of butadiene and styrene, butadiene rubber (BR) that is obtained by polymerization of butadiene, acrylonitrile-butadiene rubber (NBR) that is a copolymer of butadiene and acrylonitrile, chloroprene rubber that is obtained by polymerization of chloroprene, and the like.

For example, in the case of SBR, the amount of water that is used in polymerization is preferably selected in the range of from 100 parts by weight to 250 parts by weight, and more preferably from 150 parts by weight to 200 parts by weight with respect to 100 parts by weight of monomer. As an emulsifier, an anionic surfactant such as fatty acid soap, rosin acid soap, sodium naphthalenesulfonate-formalin condensate or sodium alkylbenzene sulfonate, or a nonionic surfactant such as polyoxyethylene alkyl ether is used. These emulsifiers are appropriately combined to be used. However, the amount thereof is preferably from 2 parts by weight to 8 parts by weight per 100 parts by weight of monomer as a total amount of the emulsifier.

As a polymerization initiator, potassium persulfate is appropriately used in a so-called hot rubber process in which the polymerization is performed at a high temperature from 30° C. to 60° C. The amount used is preferably from 0.03 part by weight to 3.0 parts by weight per 100 parts by weight of monomer. In addition, in general, in a so-called cold rubber process in which the polymerization is performed at a low temperature from 0° C. to 20° C., a redox initiator, referred to as a sulfoxylate preparation, is appropriately used. As a redox initiator, it is desirable that organic peroxide, such as cumene hydroperoxide, diisopropylbenzene hydroperoxide or p-menthane hydroperoxide, and ferrous sulfate be combined to be used. The amount of the organic peroxide used is preferably from 0.01 part by weight to 0.1 part by weight with respect to 100 parts by weight of monomer, and the amount of the ferrous sulfate used is preferably from 0.005 part by weight to 0.07 part by weight with respect to 100 parts by weight of monomer. In the sulfoxylate preparation, sodium ethylenediaminotetraacetate is chelated and added together with a reducing agent such as sodium formaldehyde sulfoxylate. At this time, the amount of the reducing agent used is preferably from 0.01 part by weight to 0.5 part by weight with respect to 100 parts by weight of monomer.

An electrolyte such as potassium chloride and tripotassium phosphate that is used to prevent the gelation of latex is preferably selected and used in the range of from 0.2 part by weight to 0.5 part by weight per 100 parts by weight of monomer. The molecular weight may be adjusted by addition to a polymerization system such as n-dodecylmercaptan, t-dodecylmercaptan and t-nonylmercaptan, and the amount used is preferably selected in the range of from 0.05 part by weight to 1.0 part by weight with respect to 100 parts by weight of monomer.

Basically, in the emulsion polymerization of BR and the like, a method similar to that for the case of the above-described emulsion polymerization of SBR may be employed.

In this exemplary embodiment, in addition to the elastomers, a polyester resin is preferably contained, and an amorphous polyester resin is more preferably contained as the binder resin from the viewpoint of low-temperature fixability, image strength, and durability of offset to polyvinyl chloride (hereinafter, referred to as "polyvinyl chloride offset resistance" in some cases).

The polyester resin is synthesized by, for example, polycondensation of polyvalent carboxylic acids and polyols in most cases.

In addition, in this exemplary embodiment, the "amorphous polyester resin" is a resin having a stepped endothermic change without a clear endothermic peak in the differential scanning calorimetry (hereinafter, abbreviated as "DSC" in some cases), or a resin with no recognized definite endothermic peak. That is, it means that in the differential scanning calorimetry (DSC), a resin of which the half width of the endothermic peak is greater than 15° C. when measured at a temperature increase rate of 10° C./min, or a resin with no recognized definite endothermic peak is amorphous.

Examples of the polyvalent carboxylic acid include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric acid, succinic acid, alkyenyl succinic anhydride and adipic acid; alicyclic carboxylic acids such as cyclohexanedicarboxylic acid; and lower alkyl esters and acid anhydrides thereof. In this exemplary embodiment, the lower alkyl ester is alkyl ester having a carbon number of from 1 to 8.

These polyvalent carboxylic acids may be used singly or in combination of two or more kinds.

Among these polyvalent carboxylic acids, aromatic carboxylic acids are preferably used.

In addition, for the purpose of securing excellent fixability, tri- or higher-valent carboxylic acid (trimellitic acid and its acid anhydride) may also be used together with dicarboxylic acid in order to form a cross-linked structure or a branched structure.

Examples of the polyol include aliphatic diols such as ethylene glycol, diethylene glycol, triethylene glycol, propylene glycol, butanediol, hexanediol and neopentyl glycol; alicyclic dials such as cyclohexane diol, cyclohexanedimethanol and hydrogen-added bisphenol A; and aromatic dials such as ethylene oxide adduct of bisphenol A and propylene oxide adduct of bisphenol A.

These polyols may be used singly or in combination of two or more kinds.

Among these polyols, aromatic dials and alicyclic dials are preferably used, and aromatic diols are more preferably used.

In addition, for the purpose of securing superior fixability, tri- or higher-valent polyol (for example, glycerin, trimethylolpropane, pentaerythritol, and the like) may also be used together with diols in order to form a cross-linked structure or a branched structure.

The content of the amorphous polyester resin is preferably from 5% by weight to 60% by weight (or from about 5% by weight to about 60% by weight) of the entire binder resin, more preferably from 10% by weight to 50% by weight, and even more preferably from 20% by weight to 40% by weight. When the content of the amorphous polyester resin is 5% by weight or greater, the sticky feeling of an image is improved, and as a result, image peeling due to rubbing is suppressed and excellent concealing ability is obtained. In addition, when the content of the amorphous polyester resin is 60% by weight or less, excellent peelability is obtained.

The glass transition temperature (Tg) of the amorphous polyester resin is preferably from 15° C. to 70° C. (or from about 15° C. to about 70° C.), more preferably from 20° C. to 65° C., and even more preferably from 30° C. to 65° C. When Tg is 70° C. or lower, excellent low-temperature fixability is obtained. When Tg is 15° C. or higher, excellent heat-resistant storability is obtained. In addition, the fixed image has excellent storability.

The Young's modulus of the amorphous polyester resin is preferably from $10^{0.4}$ MPa to $10^{3.7}$ MPa (or from about $10^{0.4}$ MPa to about $10^{3.7}$ MPa), more preferably from $10^{0.7}$ MPa to $10^{3.5}$ MPa, and even more preferably from $10^{1.0}$ MPa to $10^{3.2}$ MPa. Since the image is fixed well and good concealing ability is obtained, it is desirable that the Young's modulus of the amorphous polyester resin be $10^{0.4}$ MPa or greater. In addition, since it is possible to obtain peelability of a level at which the image of a base is not broken, it is desirable that the Young's modulus of the amorphous polyester resin be $10^{3.7}$ MPa or less.

The acid value of the amorphous polyester resin is preferably from 5 mgKOH/g to 25 mgKOH/g, and more preferably from 6 mgKOH/g to 23 mgKOH/g. When the acid value is 5 mgKOH/g or greater, the toner has good affinity to paper and good electrostatic property is obtained. In addition, when the toner is manufactured by an emulsion aggregation method to be described later, emulsion particles are easily prepared, and the rate of aggregation in the aggregation process of the emulsion aggregation method and the rate of shape change in the coalescence process are suppressed from increasing, whereby the particle size and shape are easily controlled. In addition, when the acid value of the amorphous polyester resin is 25 mgKOH/g or less, environmental dependence of charging is not adversively affected. In addition, the aggregation rate in the aggregation process in the toner manufacturing in the emulsion aggregation method and the rate of shape change in the coalescence process are suppressed from being lowered, and thus productivity is not lowered.

The weight average molecular weight (Mw) of the amorphous polyester resin is preferably from 5,000 to 1,000,000, and more preferably from 7,000 to 500,000. In addition, the number average molecular weight (Mn) of the amorphous polyester resin is preferably from 2,000 to 100,000. In addition, the molecular weight distribution Mw/Mn is preferably from 1.5 to 100, and more preferably from 2 to 60. Since the fixed image may obtain excellent strength without damaging the low-temperature fixability, it is desirable that the weight average molecular weight, the number average molecular weight and the molecular weight distribution of the amorphous polyester resin be in the above ranges, respectively.

In this exemplary embodiment, the weight average molecular weight and the number average molecular weight of the polyester resin are measured and calculated by gel permeation chromatography (GPC). Specifically, HLC-8120 (manufactured by Tosoh Corporation) is used in GPC, TSK-gel Super HM-M (15 cm) (manufactured by Tosoh Corporation) is used as a column, and a polyester resin is dissolved by a THF (tetrahydrofuran) solvent to perform the measurement. Next, using a molecular weight calibration curve created by a monodisperse polystyrene standard sample, the molecular weight of the polyester resin is calculated.

The polyester resin manufacturing method is not particularly limited. As an example thereof, there is a known polyester resin manufacturing method of reacting an acid component and an alcohol component. For example, direct polycondensation, ester exchange and the like are properly used in accordance with the kinds of an acid component and an alcohol component to manufacture a polyester resin. The molar ratio (acid component/alcohol component) in the reaction between the acid component and the alcohol component varies in accordance with reaction conditions and the like, and thus it may not be said definitely. However, for high molecular weight, the molar ratio (acid group of the acid component/hydroxyl group of the alcohol component) is preferably from 1/0.95 to 1/1.05.

Examples of a catalyst that is used in the manufacturing of a polyester resin include alkali metal compounds such as sodium and lithium; alkaline-earth metal compounds such as magnesium and calcium; metallic compounds such as zinc, manganese, antimony, titanium, tin, zirconium and germanium; phosphite compounds; phosphate compounds; amine compounds; sulfur acids such as sulfuric acid, alkyl sulfuric acid, alkylbenzene sulfonic acid and alkoxybenzene sulfonic acid.

The electrostatic latent image developing toner according to this exemplary embodiment may contain, in addition to elastomers, other resins as a binder resin together with or in place of a polyester resin.

Examples of other resins include ethylene-based resins such as polyethylene and polypropylene, styrene-based resins such as polystyrene and α-polymethylstyrene; (meth) acrylic resins such as polymethyl (meth)acrylate, poly(meth) acrylonitrile; polyamide resins; polycarbonate resins; polyester resins; and copolymer resins thereof.

In addition, the content of other resins in the toner is preferably from 1.0% by weight to 12% by weight, more preferably from 2.0% by weight to 11% by weight, and even more preferably from 2.5% by weight to 10% by weight with respect to the total weight of the entire toner set to 100% by weight when other resins are used in combination with a polyester resin. When the content of other resins is in the above range, sufficient coloring power is obtained without damaging the low-temperature fixability.

<Other Components>

If necessary, the electrostatic latent image developing toner according to this exemplary embodiment may further contain various components such as an internal additive and a charging control agent added thereto in addition to the above-described components.

Examples of the internal additive include metals such as ferrite, magnetite, reduced iron, cobalt, nickel and manganese, magnetic materials such as compounds containing alloys or the metals, and the like.

Examples of the charging control agent include dyes formed of a complex such as a quaternary ammonium salt compound, a nigrosine-based compound, aluminum, iron and chromium, triphenylmethane-based pigments and the like.

<Characteristics of Toner>

In this exemplary embodiment, a shape factor SF1 of the electrostatic latent image developing toner is preferably from 115 to 140. The closer the shape of the toner particles to a sphere, the better from the viewpoint of developability and transferability. However, in some cases, the cleanability is poor in comparison to the case of an indeterminate shape. The shape factor SF1 of the toner is more preferably from 120 to 138. When the toner has a shape factor in the above range, transfer efficiency and image precision are improved and a high-quality image is formed. In addition, the cleanability of the surface of a photoreceptor (image holding member) increases.

Here, the above-described shape factor SF1 is obtained by the following expression.

$$SF1=((ML)^2/A)\times(\pi/4)\times 100$$

In the expression, ML represents an absolute maximum length of toner particles, and A represents a projected area of toner particles.

SF1 is calculated as follows. In most cases, a microscopic image or an image of a scanning electron microscope (SEM) is analyzed using an image analyzer to be digitalized. For example, an optical microscopic image of particles sprayed on the surface of a glass slide is scanned to an image analyzer LUZEX through a video camera, the maximum lengths and the projected areas of 100 particles are obtained for calculation using the above-described expression, and an average value thereof is obtained.

In addition, in this exemplary embodiment, A volume average particle size $D_{50V}$ of the electrostatic latent image developing toner is preferably from 3 μm to 9 μm, more preferably from 3.1 μm to 8.5 μm, and even more preferably from 3.2 μm to 8.0 μm. When the volume average particle size is 3 μm or greater, the fluidity of the toner is suppressed from being lowered and the electrostatic property of particles is easily maintained. In addition, the charging distribution is not widened, transfer to the frame (non-image region) is prevented, and the toner does not easily overflow from the developing machine. Furthermore, when the volume average particle size of the toner is 3 μm or greater, the cleanability becomes better. When the volume average particle size is 9 μm or less, the resolution is suppressed from being lowered and a sufficient image quality is obtained.

In addition, a volume average particle size distribution index GSDv of the obtained toner is preferably 1.30 or less. Since excellent resolution is obtained and image defects such as Conner scattering and fogging are not caused, it is desirable that GSDv be 1.30 or less.

Here, the cumulative volume average particle size and volume average particle size distribution index may be measured by a measuring machine such as Coulter Counter TAII (manufactured by Nikkaki Bios) or Multisizer II (manufactured by Nikkaki Bios). A cumulative distribution is drawn from the smallest diameter side for the volume and the number in particle size ranges (channels) divided on the basis of the particle size distribution. The particle size corresponding to a cumulative count of 16% is defined as volume $D_{16V}$, number $D_{16P}$, the particle size corresponding to a cumulative count of 50% is defined as volume $D_{50V}$, number $D_{50P}$, and the particle size corresponding to a cumulative count of 84% is defined as volume $D_{84V}$, number $D_{84P}$. Using them, the volume average particle size distribution index (GSDv) is calculated as $(D_{84V}/D_{16V})^{1/2}$ and the number average particle size distribution index (GSDp) is calculated as $(D_{84P}/D_{16P})^{1/2}$.

(Method of Manufacturing Electrostatic Latent Image Developing Toner)

The method of manufacturing the electrostatic latent image developing toner according to this exemplary embodiment is not particularly limited if it is possible to obtain a toner satisfying the above-described conditions.

Examples of the method of producing an electrostatic latent image developing toner include dry methods such as a kneading pulverization method and wet methods such as a melting suspension method, an emulsion aggregation method and a dissolution suspension method. Among them, the toner is preferably prepared by an emulsion aggregation method.

The emulsion aggregation method is a method in which dispersions (emulsion liquid, pigment dispersion and the like) containing components (release agent, binder resin, pigment and the like) contained in toner particles are prepared and mixed to aggregate the components contained in the toner particles to each other to thereby prepare aggregated particles, and then the aggregated particles are heated to at least the melting temperature (melting point) or the glass transition temperature of the binder resin to subject the aggregated particles to heat fusion.

Through the emulsion aggregation method, toner particles having a small particle size are easily prepared and toner particles having a narrow particle size distribution are easily obtained in comparison to a kneading pulverization method that is a dry method, and a melting suspension method, a dissolution suspension method and the like that are wet methods. In addition, shape control is easily performed and toner particles having a uniform indeterminate shape are prepared in comparison to a melting suspension method, a dissolution suspension method and the like. Furthermore, control for the structure of toner particles, such as film formation, is possible, and when a release agent or a crystalline polyester resin is contained, exposure of the release agent and the crystalline polyester resin to surface is suppressed, and thus deterioration in electrostatic property and storability is prevented.

Next, the manufacturing process of the emulsion aggregation method will be described in detail.

It is desirable that the emulsion aggregation method has at least an emulsification process of emulsifying a raw material for toner particles to form resin particles (emulsion particles), an aggregation process of forming aggregates of the resin particles, and a coalescence process of coalescing the aggregates. Hereinafter, an example of the process of manufacturing toner particles by the emulsion aggregation method will be described for the respective processes.

[Emulsification Process]

Examples of a method of preparing the emulsion liquid include a phase inversion emulsification method, a melting emulsification method and the like.

In the phase inversion emulsification method, a resin to be dispersed is dissolved in a hydrophobic organic solvent in which the resin is soluble, and a base is added to an organic continuous phase (oil phase; O) for neutralization. Thereafter, by adding an aqueous medium (water phase; W), the water-in-oil (W/O) system inverts into the oil-in-water (O/W), and thus the phase inversion of the organic continuous phase with the presence of the resin into the discontinuous phase is carried out. Accordingly, the resin is dispersed and stabilized in a particle shape in the aqueous medium and the emulsion liquid is prepared.

In the melting emulsification method, the emulsion liquid is prepared by applying a shearing force to a solution, that is obtained by mixing an aqueous medium and a resin, by a dispersing machine. At this time, the viscosity of the resin component is reduced by heating to form particles. In addition, a dispersant may be used to stabilize the dispersed resin particles. Furthermore, when the resin is oil-based and has relatively low solubility to water, the resin is dissolved in a solvent in which the resin is dissolved to disperse the particles together with a dispersant or a high-molecular electrolyte in the water, and then the solvent is evaporated by heating or depressurization. The emulsion liquid in which the resin particles are dispersed may be prepared in this manner.

Examples of the dispersing machine that is used in dispersion of the emulsion liquid by the melting emulsification method include homogenizers, homomixers, pressure kneaders, extruders, medium dispersing machines and the like.

Examples of the aqueous medium include water such as distillated water and ion exchange water; alcohols; and the like. However, the aqueous medium is preferably just water.

In addition, examples of the dispersant that is used in the emulsification process include water-soluble polymers such as polyvinyl alcohol, methylcellulose, ethylcellulose, hydroxyethyl cellulose, carboxymethylcellulose, sodium polyacrylate and sodium polymethacrylate; and surfactants such as anionic surfactants, e.g., sodium dodecylbenzenesulfonate, sodium octadecylsulfate, sodium oleate, sodium laurate and potassium stearate, cationic surfactants, e.g., laurylamine acetate, stearylamine acerate and lauryltrimethylammonium chloride, amphoteric ionic surfactants, e.g., lauryldimethylamine oxide, and nonionic surfactants, e.g., polyoxyethylene alkyl ether, polyoxyethylene alkylphenyl ether and polyoxyethylene alkylamine. Among them, anionic surfactants are preferably used from the viewpoint of ease of washing and environmental adaptability.

The content of the resin particles that are contained in the emulsion liquid in the emulsification process is preferably from 10 to 50 weigh %, and more preferably from 20% by weight to 40% by weight. When the content is 10% by weight or greater, the particle size distribution is not excessively widened. In addition, when the content is 50% by weight or less, it is possible to perform the stirring without variation and toner particles having a narrow particle size distribution and uniform characteristics are obtained.

The volume average particle size of the resin particles is preferably from 0.08 μm to 0.8 μm, more preferably from 0.09 μm to 0.6 μm, and even more preferably from 0.10 μm to 0.5 μm. When the volume average particle size is 0.08 μm or greater, the resin particles are easily aggregated. In addition, when the volume average particle size is 0.8 μm or less, the particle size distribution of the toner particles is not easily widened and the precipitation of the emulsion particles is suppressed, whereby the storability of the emulsion particle dispersion is improved.

Before the aggregation process to be described later, it is desirable to prepare dispersions in which the pigment, release agent and the like that are toner particle components other than the binder resin are dispersed.

In addition, in addition to the method of preparing a dispersion corresponding to each of the components such as the binder resin and the pigment, for example, when an emulsion liquid of a certain component is prepared, other components may be added to the solvent to emulsify two or more components at the same time so that the plural components are contained in the dispersed particles.

[Aggregation Process]

In the aggregation process, it is desirable that the dispersion of the resin particles obtained in the emulsification process, a release agent dispersion, a pigment dispersion and the like be mixed to prepare a mixture, and the mixture be heated at a temperature that is equal to or lower than the glass transition temperature of the binder resin to be aggregated so as to form aggregated particles. It is desirable that the aggregated particles be formed by acidifying the pH of the mixture under the stirring. The pH is preferably in the range of from 2 to 7, more preferably from 2.2 to 6, and even more preferably from 2.4 to 5.

In the formation of the aggregated particles, it is also effective to use an aggregating agent. As the aggregating agent, a surfactant with the reverse polarity to the polarity of the above-described surfactant that is used as the dispersant, inorganic metallic salt, and a di- or higher-valent metallic complex are appropriately used. Since the used amount of the surfactant may be reduced and the charging characteristics are improved, a metallic complex is particularly preferably used.

Examples of the inorganic metallic salt include metallic salts such as calcium chloride, calcium nitrate, barium chloride, magnesium chloride, zinc chloride, aluminum chloride and aluminum sulfate, and inorganic metallic salt polymers such as polyaluminum chloride, polyaluminum hydroxide and polycalcium sulfide. Among them, aluminum salt and a polymer thereof are particularly preferably used. In order to obtain a narrower particle size distribution, the valence of the inorganic metallic salt is preferably larger, i.e., divalent is better than monovalent, trivalent is better than divalent, and tetravalent is better than trivalent, and in the case of the same valence number, an inorganic metallic salt polymer is more preferably used.

In addition, when the aggregated particles have a desired particle size, resin particles (resin emulsion particles) may be added to prepare toner particles having a configuration in which the surface of a core aggregated particle is coated with the binder resin. In this case, since the release agent and the crystalline polyester resin are not easily exposed to the toner particle surface, it is desirable to employ the above configuration from the viewpoint of the electrostatic property and the storability. When the resin particles are added, an aggregating agent may be added before the addition of the resin particles, or the pH may be adjusted.

[Coalescence Process]

In the coalescence process, it is desirable that under the stirring conditions based on the aggregation process, the pH of a suspension of the aggregated particles be increased in the range of from 4 to 8 to stop the proceeding of the aggregation and heating at a temperature that is equal to or higher than the glass transition temperature of the binder resin be performed, whereby the aggregated particles are subjected to coalescence. As an alkaline solution that is used to increase the pH, it is desirable to use an aqueous solution of NaOH. In comparison to other alkaline solutions such as an ammonia solution, the aqueous solution of NaOH has low volatility and high safety. In addition, in comparison to divalent alkaline solutions such as $Ca(OH)_2$, the aqueous solution of NaOH has excellent solubility to water, and a necessary amount thereof is small. Moreover, the aqueous solution of NaOH is excellent in the ability to stop the aggregation.

The heating may be performed for a time in which the coalescence is performed between particles, and is preferably from 0.5 to 10 hours. The cooling is performed after the coalescence of the aggregated particles and coalesced particles are thus obtained. In addition, in the cooling process, by performing so-called rapid cooling for increasing the cooling rate to near the melting temperature (melting temperature±10° C.) of the release agent or the binder resin, the recrystallization of the release agent or the binder resin may be suppressed and the exposure to surface may thus be suppressed.

Next, through a washing process of removing impurities on the surface by repeating solid-liquid separation by filtering and a water washing process using ion exchange water, a dispersion of toner particles may be obtained.

The toner particles that are used in this exemplary embodiment are prepared also by a kneading pulverization method.

In order to prepare toner particles by the kneading pulverization method, a method of preparing toner particles having an intended particle size, including: melting and kneading a binder resin, a colorant, a release agent and the like by, for example, a pressure kneader, a roll mill, an extruder or the like to be dispersed; cooling the resultant material; finely pulverizing the cooled material by a jet mill or the like; and performing classification by a classifier such as a wind classifier is used.

If necessary, a well-known external additive such as inorganic particles and organic particles may be added to the electrostatic latent image developing toner according to this exemplary embodiment.

Examples of the inorganic particles that are used as an external additive include silica, alumina, titanium oxide, barium titanate, magnesium titanate, calcium titanate, strontium titanate, zinc oxide, silica sand, clay, mica, wollastonite, diatomaceous earth, cerium chloride, colcothar, chromium oxide, cerium oxide, antimony trioxide, magnesium oxide, zirconium oxide, silicon carbide, silicon nitride, and the like. Among them, silica particles and titanium oxide particles are preferably used, and hydrophobized particles are particularly preferably used.

In general, inorganic particles are used for the purpose of improving fluidity. The primary particle size of the inorganic particles is preferably in the range of from 1 nm to 200 nm, and an amount thereof is preferably in the range of from 0.01 part by weight to 20 parts by weight with respect to 100 parts by weight of the toner.

In general, the organic particles that are used as an external additive are used for the purpose of improving the cleanability and transferability. Specific examples thereof include polystyrene, polymethyl methacrylate, polyvinylidene fluoride and the like.

(Electrostatic Latent Image Developer)

The electrostatic latent image developing toner according to this exemplary embodiment may be used as a nonmagnetic single-component developer, or as a two-component developer. When being used as a two-component developer, the electrostatic latent image developing toner is mixed with a carrier to be used.

The carrier that may be used in a two-component developer is not particularly limited, and a known carrier is used. Examples thereof include magnetic metals such as iron oxide, nickel and cobalt, magnetic oxides such as ferrite and magnetite, resin-coated carriers having a resin coating layer on the surface of a core material thereof, a magnetic dispersion-type carrier and the like. Examples of the carrier may further include a resin dispersion-type carrier in which a conductive material or the like is dispersed in a matrix resin.

Examples of the coating resin and the matrix resin to be used in the carrier include, but not limited thereto, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene acrylic acid copolymer, a straight silicone resin containing an organosiloxane bond or a modified article thereof, a fluorine resin, polyester, polycarbonate, a phenol resin, an epoxy resin, and the like.

Examples of the conductive material include, but not limited thereto, metals such as gold, silver and copper, titanium oxide, zinc oxide, barium sulfate, aluminum borate, potassium titanate, tin oxide, carbon black, and the like.

Examples of the core material of the carrier include magnetic metals such as iron, nickel and cobalt, magnetic oxides such as ferrite and magnetite, glass beads, and the like. In order to use the carrier for a magnetic brush method, the carrier is preferably a magnetic material. The volume average particle size of the core material of the carrier is preferably in the range of from 10 μm to 500 μm and more preferably from 30 μm to 100 μm.

In addition, for coating the surface of the core material of the carrier with a resin, a method of performing coating with a coating layer forming solution in which the above-described coating resin, and if necessary, various additives are dissolved in a proper solvent, or the like is used. The solvent is not particularly limited, and may be selected in view of the coating resin to be used, a coating property and the like.

Specific resin coating methods include a dipping method of dipping the core material of a carrier in a solution for forming a coating layer, a spray method of spraying a solution for forming a coating layer to the surface of the core material of a carrier, a fluidized-bed method of spraying a solution for forming a coating layer in a state in which the core material of a carrier is floated by a fluidizing air, a kneader coater method including mixing the core material of a carrier and a coating layer forming solution in a kneader coater and removing a solvent, and the like.

The mixing ratio (weight ratio) of the electrostatic latent image developing toner according to this exemplary embodiment and the carrier in the two-component developer is preferably in the range of from 1:100 to 30:100 (=toner:carrier), and more preferably from 3:100 to 20:100.

(Cartridge, Image Forming Method, and Image Forming Apparatus)

Next, a cartridge according to this exemplary embodiment will be described.

The cartridge according to this exemplary embodiment is a cartridge containing at least the electrostatic latent image developing toner according to this exemplary embodiment or the electrostatic latent image developer according to this exemplary embodiment. In addition, it is desirable that the cartridge according to this exemplary embodiment be detachable from an image forming apparatus.

When being used in a developing apparatus, and image forming method, or an image forming apparatus, the cartridge may be a toner cartridge containing the toner singly, a developer cartridge containing the electrostatic latent image developer according to this exemplary embodiment, or a process cartridge provided with at least a developing unit that develops an electrostatic latent image formed on an image holding member by the electrostatic latent image developing toner according to this exemplary embodiment or the electrostatic latent image developer according to this exemplary embodiment to form a toner image.

In addition, if necessary, the cartridge according to this exemplary embodiment may include other members such as an erasing unit.

An image forming method according to this exemplary embodiment includes a charging process of charging a surface of an image holding member, a latent image forming process of forming an electrostatic latent image on the surface of the image holding member, a developing process of developing the electrostatic latent image formed on the surface of the image holding member by using a developer to form a toner image, and a transfer process of transferring the toner image formed on the surface of the image holding member onto the surface of a transfer medium. The image forming method according to this exemplary embodiment may further include a fixing process of fixing the toner image transferred onto the surface of the transfer medium, and it is desirable that the toner in the developer is the electrostatic latent image developing toner according to this exemplary embodiment.

It is desirable that the toner be used as a developer containing a toner. Even when the toner is the electrostatic latent image developing toner according to this exemplary embodiment, the toner may be a two-component developer containing the electrostatic latent image developing toner according to this exemplary embodiment and a carrier.

In the image forming method according to this exemplary embodiment, a developer containing the electrostatic latent image developing toner according to this exemplary embodiment is prepared, an electrostatic image is formed and developed by a common electrophotographic copier with the use of the developer, the obtained toner image is electrostatically transferred onto transfer paper, the transferred image is fixed by a heating roller fixing machine in which the temperature of a heating roller is set to a predetermined temperature, and thus a copy image is formed.

The above-described respective processes are general processes that are described in, for example, JP-A-56-40868, JP-A-49-91231 and the like. The image forming method according to this exemplary embodiment may be performed using an image forming apparatus such as a known copier, fax machine or the like.

The electrostatic latent image forming process is a process of forming an electrostatic latent image on an image holding member (photoreceptor).

The developing process is a process of developing the electrostatic latent image by a developer layer on a developer holding member to form a toner image. The developer layer is not particularly limited if it contains the electrostatic latent image developing toner according to this exemplary embodiment.

The transfer process is a process of transferring the toner image onto a transfer medium. In addition, examples of the transfer medium in the transfer process include an intermediate transfer member and a recording medium such as paper.

In the fixing process, a method of fixing the toner image transferred onto the transfer paper by, for example, a heating roller fixing machine in which the temperature of a heating roller is set to a predetermined temperature to form a copy image is used.

The cleaning process is a process of removing the electrostatic latent image developer remaining on the image holding member.

As the recording medium, a known medium may be used, and examples thereof include paper that is used in electrophotographic copiers, printers, and the like, OHP sheets, and the like, and for example, coated paper in which the surface of plain paper is coated with a resin or the like, art paper for printing, and the like may be appropriately used.

It is desirable that the image forming method according to this exemplary embodiment further include a recycling process. The recycling process is a process of moving the electrostatic latent image developing toner recovered in the cleaning process to the developer layer. The image forming method including the recycling process may be performed using an image forming apparatus such as a toner recycling system-type copier, fax machine or the like. In addition, the image forming method may also be applied to a recycling system in which the cleaning process is omitted and the toner is recovered simultaneously with the developing.

The image forming apparatus according to this exemplary embodiment has an image holding member; a charging unit that latents the image holding member; a latent image forming unit that forms an electrostatic latent image on the surface of the image holding member, a developing unit that develops the electrostatic latent image by a developer containing a toner to form a toner image, and a transfer unit that transfers the toner image onto a transfer medium from the image holding member, and it is desirable that the developer containing a toner contains the electrostatic latent image developing toner according to this exemplary embodiment.

The image forming apparatus according to this exemplary embodiment is not particularly limited if it includes at least the above-described image holding member, charging unit, latent image forming (exposure) unit, developing unit and transfer unit. If necessary, the image forming apparatus may include a fixing unit, a cleaning unit, an erasing unit and the like.

The transfer unit may perform two or more transfer operations by using an intermediate transfer member. In addition, examples of the transfer medium in the transfer unit include an intermediate transfer member and a recording medium such as paper.

It is desirable that the image holding member and the respective units use the configurations described in the respective processes of the above-described image forming method. All of the respective units may use known units in the image forming apparatus. In addition, the image forming apparatus according to this exemplary embodiment may include units, devices and the like other than the above-described configuration. In addition, in the image forming apparatus according to this exemplary embodiment, the plural units may operate at the same time.

An example of the image forming apparatus according to this exemplary embodiment will be described with reference to FIG. 1, but does not limit this exemplary embodiment. FIG. 1 is a schematic cross-sectional view showing an example of an image forming apparatus using an electrostatic latent image developer.

FIG. 1 is a schematic view showing an example of the configuration of an image forming apparatus for forming an image by the image forming method according to this exemplary embodiment. An image forming apparatus 200 shown in the drawing has four electrophotographic photoreceptors (image supporting bodies) 401*a* to 401*d* that are arranged in a line along an intermediate transfer belt 409 in a housing 400. Regarding the electrophotographic photoreceptors 401*a* to 401*d*, for example, the electrophotographic photoreceptor 401*a* may form a yellow image, the electrophotographic photoreceptor 401*b* may form a magenta image, the electrophotographic photoreceptor 401*c* may form a cyan image, and the electrophotographic photoreceptor 401*d* may form a black image.

Each of the electrophotographic photoreceptors 401*a* to 401*d* is rotatable in a predetermined direction (counterclockwise direction in the drawing), and along the rotation direction, charging rolls 402*a* to 402*d*, developing devices 404*a* to 404*d*, primary transfer rolls 410*a* to 410*d*, and cleaning blades 415*a* to 415*d* are disposed. The respective developing devices 404*a* to 404*d* may be supplied with four color toners of black, yellow, magenta and cyan contained in toner cartridges 405*a* to 405*d*, and the respective primary transfer rolls 410*a* to 410*d* come into contact with the electrophotographic photoreceptors 401*a* to 401*d* via the intermediate transfer belt 409.

Furthermore, an exposure device 403 is disposed at a predetermined position in the housing 400, and surfaces of the charged electrophotographic photoreceptors 401*a* to 401*d* may be irradiated with the light beams emitted from the exposure device 403. Accordingly, in the rotation process of the electrophotographic photoreceptors 401*a* to 401*d*, the charging, exposure, developing, primary transfer, and cleaning processes are sequentially performed, and the respective color toner images are transferred to overlap each other on the intermediate transfer belt 409.

Here, the charging rolls 402*a* to 402*d* bring a conductive member (charging roll) into contact with the surfaces of the electrophotographic photoreceptors 401*a* to 401*d* to uniformly apply a voltage to the photoreceptor and charge the photoreceptor surface to a predetermined potential (charging process). The charging by the contact charging method may be performed using a charging brush, a charging film, a charging tube or the like other than the charging roll shown in this exemplary embodiment. In addition, the charging may be performed by a noncontact method using a corotron or a scorotron.

As the exposure device 403, an optical system and the like capable of performing the imagewise exposure of the surfaces of the electrophotographic photoreceptors 401*a* to 401*d* using a light source such as a semiconductor laser, a light emitting diode (LED), a liquid crystal shutter or the like may be used. Among them, when an exposure device capable of performing the exposure with incoherent light is used, it is possible to prevent the interference fringe between the photosensitive layer and the conductive base of the electrophotographic photoreceptors 401*a* to 401*d*.

As the developing devices 404*a* to 404*d*, general developing devices that develop the image in a manner of contacting or noncontacting the electrostatic latent image developer may be used (developing process). Such developing devices are not particularly limited if these use the developer for developing an electrostatic latent image, and a known device may be appropriately selected in accordance with the purpose. In the primary transfer process, by applying a primary transfer bias with the reverse polarity to the polarity of the toner on the image holding member to the primary transfer rolls 410*a* to 410*d*, the respective color toners are sequentially primarily transferred from the image holding member to the intermediate transfer belt 409.

The cleaning blades 415*a* to 415*d* are used to remove the remaining toner adhering to the surface of the electrophotographic photoreceptor after the transfer process. Accordingly, the electrophotographic photoreceptor of which the surface is cleaned is repeatedly provided to the above-described image forming process. Examples of the material of the cleaning blade include urethane rubber, neoprene rubber, silicon rubber and the like.

The intermediate transfer belt 409 is supported with a predetermined tension by a driving roll 406, a backup roll 408 and a tension roll 407, and may be rotated without the occurrence of warpage by the rotation of the rolls. In addition, a secondary transfer roll 413 is disposed to come into contact with the backup roll 408 via the intermediate transfer belt 409.

By applying a secondary transfer bias with the reverse polarity to the polarity of the toner on the intermediate transfer member to the secondary transfer roll 413, the toner is secondarily transferred from the intermediate transfer belt to a recording medium. By, for example, a cleaning blade 416 disposed in the vicinity of the driving roll 406 or a static eliminator (not shown), the surface of the intermediate transfer belt 409 passing between the backup roll 408 and the secondary transfer roll 413 is cleaned, and then the intermediate transfer belt 409 is repeatedly provided to the next image forming process. In addition, a tray (recording medium tray) 411 is provided at a predetermined position in the housing 400, and recording mediums 500 such as paper in the tray 411 are sequentially transferred between the intermediate transfer belt 409 and the secondary transfer roll 413, and further between two fixing rolls 414 coming into contact with each other by a transfer roll 412, and then fed to the outside of the housing 400.

EXAMPLES

Hereinafter, this exemplary embodiment will be described in more detail using examples and comparative examples, but is not limited to the following examples. "Parts" and "%" represent "parts by weight" and "% by weight", respectively, unless specifically noted.

<Glass Transition Temperature Measurement Method>

The glass transition temperature of a toner is determined by a differential scanning calorimeter (DSC) measurement method, and is obtained by a main peak that is measured in accordance with ASTMD 3418-8.

The main peak is measured using DSC-7 (manufactured by PerkinElmer Co., Ltd.). The melting points of indium and zinc are used in the temperature correction of a detector of the device, and melting heat of indium is used in the correction of a heat quantity. As a sample, a pan made of aluminum is used, an empty pan is set for comparison, and the measurement is performed at a temperature increase rate of 10° C./min.

<Young's Modulus Measurement Method>

The test is performed on the basis of "plastic-tensile property test method" described in JIS K7161:94.

<Mw and Mn Measurement>

The weight average molecular weight (Mw) and the number average molecular weight (Mn) are measured and calculated by gel permeation chromatography (GPC). Specifically, HLC-8120 (manufactured by Tosoh Corporation) is used in GPC, TSKgel Super HM-M (15 cm) (manufactured by Tosoh Corporation) is used as a column, and a polyester resin is dissolved by a THF (tetrahydrofuran) solvent to perform the measurement. Next, using a molecular weight calibration curve created by a monodisperse polystyrene standard sample, the molecular weight of the polyester resin is calculated.

<Preparation of Styrene-Butadiene Copolymer (SBR) Resin Particle Dispersion 1 (SBR1)>

Butadiene: 75.0 parts
Styrene: 25.0 parts
n-Dodecylmercaptan: 0.5 part
Potassium Peroxydisulfate: 0.3 part
Sodium Alkylbenzene Sulfonate: 5.0 parts
Water: 180 parts This standard mixture is held for 10 hours at a polymerization temperature of 50° C. Hydroquinone (0.1 part by weight) is added to stop the polymerization. In order to remove the unreacted monomer, first, flash distillation is performed at atmospheric pressure, and then under reduced pressure to eliminate the butadiene, and next, steam stripping is performed in the column to eliminate the styrene. The particle size of the obtained resin particle dispersion is 160 nm.

<Preparation of Styrene-Butadiene Copolymer (SBR) Resin Particle Dispersion 2 (SBR2)>

An SBR resin particle dispersion 2 (SBR2) is prepared in a manner similar to that for SBR1, except that the styrene content and the butadiene content are changed as described in Table 1.

The glass transition temperature (Tg) and the Young's modulus of the obtained SBR resin are shown in Table 1.

<Preparation of Styrene-Butadiene Copolymer (SBR) Resin Particle Dispersion 3 (SBR3)>

An SBR resin particle dispersion 3 (SBR3) is prepared in a manner similar to that for SBR1, except that the styrene content and the butadiene content are changed as described in Table 1.

The glass transition temperature (Tg) and the Young's modulus of the obtained SBR resin are shown in Table 1.

<Preparation of Styrene-Butadiene Copolymer (SBR) Resin Particle Dispersion 4 (SBR4)>

An SBR resin particle dispersion 4 (SBR4) is prepared in a manner similar to that for SBR1, except that the styrene content and the butadiene content are changed as described in Table 1.

The glass transition temperature (Tg) and the Young's modulus of the obtained SBR resin are shown in Table 1.

<Preparation of Styrene-Butadiene Copolymer (SBR) Resin Particle Dispersion 5 (SBR5)>

An SBR resin particle dispersion 5 (SBR5) is prepared in a manner similar to that for SBR1, except that the styrene content and the butadiene content are changed as described in Table 1.

The glass transition temperature (Tg) and the Young's modulus of the obtained SBR resin are shown in Table 1.

TABLE 1

| | Monomer Composition | | | |
|---|---|---|---|---|
| | Styrene Content (wt %) | Butadiene Content (wt %) | Tg (° C.) | Young's Modulus (MPa) |
| SBR1 | 25 | 75 | −52 | $10^{0.5}$ |
| SBR2 | 33 | 67 | −36 | $10^{1.5}$ |
| SBR3 | 38 | 62 | −32 | $10^{2.0}$ |
| SBR4 | 47 | 53 | −21 | $10^{2.6}$ |
| SBR5 | 10 | 90 | −60 | $10^{0.5}$ |

<Preparation of Polyester Resin Particle Dispersion 1 (PES1)>

Acid components (polyvalent carboxylic acids) and alcohol components (polyols) are charged into a reaction container provided with a stirrer, a thermometer, a condenser and a nitrogen gas introducing tube with a material composition ratio (molar ratio) of PES1 shown in the following table. After replacement of the air in the reaction container with a dried nitrogen gas, 0.16% by weight of dibutyltin oxide is charged with respect to the monomer component and stirred for about 6 hours at about 195° C. under the nitrogen gas flow, and the resultant material is further stirred for about 6.0 hours at a temperature raised to about 240° C. Then, the pressure in the reaction container is reduced up to 10.0 mmHg and the stirring is performed for about 0.5 hours under reduced pressure to obtain a slightly yellow transparent amorphous polyester resin (PES1).

Next,

PES 1: 160 parts
Ethyl Acetate: 233 parts
Aqueous Sodium Hydroxide (0.3 N): 0.1 part The above components are put into a separable flask, heated at 70° C., and stirred by a three-one motor (manufactured by SHINTO Scientific Co., Ltd.) to prepare a resin mixture. While the resin mixture is further stirred, 373 parts of ion exchange water are gradually added for phase inversion emulsification and solvent removal, and thus a polyester resin particle dispersion 1 is obtained.

<Preparation of Polyester Resin Particle Dispersion 2 (PES2)>

Acid components (polyvalent carboxylic acids) and alcohol components (polyols) are charged into a reaction container provided with a stirrer, a thermometer, a condenser and a nitrogen gas introducing tube with a material composition ratio (molar ratio) of PES2 shown in the following table. After replacement of the air in the reaction container with a dried nitrogen gas, 0.16% by weight of dibutyltin oxide is charged with respect to the monomer component and stirred for about 6 hours at about 195° C. under the nitrogen gas flow, and the resultant material is further stirred for about 4.0 hours at a temperature raised to about 240° C. Then, the pressure in the reaction container is reduced up to 10.0 mmHg and the stirring is performed for about 0.5 hours under reduced pressure to obtain a slightly yellow transparent amorphous polyester resin (PES2).

Next,

PES3: 160 parts

Ethyl Acetate: 233 parts

Aqueous Sodium Hydroxide (0.3 N): 0.1 part

The above components are put into a separable flask, heated at 70° C., and stirred by a three-one motor (manufactured by SHINTO Scientific Co., Ltd.) to prepare a resin mixture. While the resin mixture is further stirred, 373 parts of ion exchange water are gradually added for phase inversion emulsification and solvent removal, and thus a polyester resin particle dispersion 2 is obtained.

<Preparation of Polyester Resin Particle Dispersion 3 (PES3)>

Acid components (polyvalent carboxylic acids) and alcohol components (polyols) are charged into a reaction container provided with a stirrer, a thermometer, a condenser and a nitrogen gas introducing tube with a material composition ratio (molar ratio) of PES3 shown in the following table. After replacement of the air in the reaction container with a dried nitrogen gas, 0.16% by weight of dibutyltin oxide is charged with respect to the monomer component and stirred for about 4 hours at about 195° C. under the nitrogen gas flow, and the resultant material is further stirred for about 6.0 hours at a temperature raised to about 240° C. Then, the pressure in the reaction container is reduced up to 10.0 mmHg and the stirring is performed for about 0.5 hours under reduced pressure to obtain a slightly yellow transparent amorphous polyester resin (PES3).

Next,

PES2: 160 parts

Ethyl Acetate: 233 parts

Aqueous Sodium Hydroxide (0.3 N): 0.1 part

The above components are put into a separable flask, heated at 70° C., and stirred by a three-one motor (manufactured by SHINTO Scientific Co., Ltd.) to prepare a resin mixture. While the resin mixture is further stirred, 373 parts of ion exchange water are gradually added for phase inversion emulsification and solvent removal, and thus a polyester resin particle dispersion 3 is obtained.

<Preparation of Polyester Resin Particle Dispersion 4 (PES4)>

Acid components (polyvalent carboxylic acids) and alcohol components (polyols) are charged into a reaction container provided with a stirrer, a thermometer, a condenser and a nitrogen gas introducing tube with a material composition ratio (molar ratio) of PES4 shown in the following table. After replacement of the air in the reaction container with a dried nitrogen gas, 0.16% by weight of dibutyltin oxide is charged with respect to the monomer component and stirred for about 10 hours at about 195° C. under the nitrogen gas flow, and the resultant material is further stirred for about 6.0 hours at a temperature raised to about 240° C. Then, the pressure in the reaction container is reduced up to 10.0 mmHg and the stirring is performed for about 0.5 hours under reduced pressure to obtain a slightly yellow transparent amorphous polyester resin (PES4).

Next,

PES4: 160 parts

Ethyl Acetate: 233 parts

Aqueous Sodium Hydroxide (0.3 N): 0.1 part

The above components are put into a separable flask, heated at 70° C., and stirred by a three-one motor (manufactured by SHINTO Scientific Co., Ltd.) to prepare a resin mixture. While the resin mixture is further stirred, 373 parts of ion exchange water are gradually added for phase inversion emulsification and solvent removal, and thus a polyester resin particle dispersion 4 is obtained.

TABLE 2

| | Monomer Composition | | | | | |
|---|---|---|---|---|---|---|
| | Polyvalent carboxylic Acid | Polyol | Ratio of Polyvalent carboxylic Acid/Polyol | Mw | Tg (° C.) | Young's Modulus (MPa) |
| PES1 | TPA/FA/DSA/TMA = 60/5/30/5 | Bis-A EO/Bis-A PO = 50/50 | 50/50 | 46,000 | 56 | $10^{3.0}$ |
| PES2 | TPA/FA/DSA/TMA = 60/5/30/5 | Bis-A EO/Ethylene Glycol = 80/10 | 60/40 | 20,000 | 34 | $10^{1.5}$ |
| PES3 | TPA/FA/DSA/TMA = 60/5/30/5 | Bis-A EO/Ethylene Glycol = 80/20 | 60/40 | 15,000 | 20 | $10^{0.5}$ |
| PES4 | TPA/FA/DSA/TMA = 60/5/30/5 | Bis-A EO/Bis-A PO = 50/50 | 40/60 | 50,000 | 65 | $10^{3.5}$ |

The components used in the above Table 2 are as follows.

TPA: Terephthalic Acid

FA: Fumaric Acid

DSA: Dodecenyl Succinic Anhydride

TMA: Trimellitic Anhydride

Bis-A EO: Bisphenol A Ethylene Oxide (2 mol) Adduct

Bis-A PO: Bisphenol A Propylene Oxide (2 mol) Adduct

In addition, the ratio of polyvalent carboxylic acid/polyol in Table 2 represents a molar ratio of polyvalent carboxylic acid and polyol.

<Preparation of Release Agent Particle Dispersion>

Hydrocarbon-based Wax (manufactured by Nippon Seiro Col., Ltd, product name: FNP0090, melting temperature Tw90.2° C.): 270 parts Anionic Surfactant (manufactured by Daiichi Kogyo Co., Ltd, Neogen RK, active component amount: 60% by weight): 13.5 parts (as an active component, 3.0% by weight with respect to the release agent)

Ion Exchange Water: 21.6 parts

The above components are mixed and a release agent is dissolved at an internal liquid temperature of 120° C. by a pressure discharge-type homogenizer (manufactured by Gaulin Inc., Gaulin homogenizer). Then, the resultant material is dispersed for 120 minutes at a dispersion pressure of 5 MPa, and continuously, for 360 minutes at 40 MPa, and is cooled to obtain a release agent dispersion. The volume average particle size $D_{50V}$ of the particles in the release agent dispersion is 225 nm. Thereafter, the ion exchange water is added to adjust the solid concentration to 20.0% by weight.

<Preparation of Pigment Dispersion 1>

An aluminum powder paste having an average particle size of 10 μm (manufactured by Toyo Aluminum K.K., Aluminum Paste 1200M) is subjected to solvent removal. Then, the obtained powder is dispersed in the following order.

Aluminum Paste 1200M after Solvent Removal: 200 parts

Anionic Surfactant (manufactured by Daiichi Kogyo Co., Ltd, Neogen SC): 33 parts (active component 60% by weight)

Ion Exchange Water: 750 parts

In a stainless-steel container having a size so that when all of the above components are charged, the height of the liquid surface is about ⅓ of the height of the container, 280 parts of the above ion exchange water and the anionic surfactant are put and the temperature is raised to 40° C. to sufficiently dissolve the surfactant. Then, the resultant material is cooled to 25° C. and the aluminum powder paste and the remaining ion exchange water are charged and stirred by using a stirrer until there is no unwetted pigment. In addition, defoaming is sufficiently performed.

<Preparation of Pigment Dispersion 2>

Using 200 parts of titanium oxide (manufactured by Ishihara Sangyo Kaisha, Ltd., P1-501A) having an average particle size of 0.1 μm, a pigment dispersion 2 is prepared in a manner similar to that for the preparation of the pigment dispersion 1.

Example 1

Method of Manufacturing Toner 1

Polyester Resin Dispersion 1: 102.8 parts (resin content 30.8 parts)

Styrene-Butadiene Copolymer Resin Particle Dispersion 1: 163.3 parts (resin content 57.3 parts)

Pigment Dispersion 1: 209.4 parts (pigment content 44 parts)

Release Agent Dispersion: 73.5 parts (release agent content 14.7 parts)

Ion Exchange Water: 320 parts

Anionic Surfactant (manufactured by Dow Chemical Company, Dowfax 2A1): 7.0 parts The above components are put into a 3 L-reaction container provided with a thermometer, a pH meter and a stirrer, and 0.3 M nitric acid is added at a temperature of 25° C. to adjust the pH to 3.0. Then, while the resultant material is dispersed at 5.000 rpm by a homogenizer (manufactured by TKA Works Gmbh & Co. KG, Ultra Turrax T50), 125 parts of an aqueous solution of aluminum sulfate (SA) prepared to have a concentration of 5% are added and dispersed for 6 minutes.

Thereafter, a stirrer and a mantle heater are installed in the reaction container. While adjusting the number of rotations of the stirrer so as to sufficiently stir the slurry, the temperature is raised at a temperature increase rate of 0.2° C./min until the temperature reaches 40° C., and further raised at a temperature increase rate of 0.05° C./min after the temperature is higher than 40° C., and the particle size is measured every 10 minutes by using Multisizer II (aperture diameter: 100 μm, manufactured by Beckman Coulter, Inc.). When the volume average particle size is 8.0 μm, the temperature is maintained.

After 30 minutes, using 4% by weight aqueous sodium hydroxide, the pH is adjusted to 9.0. Then, while adjusting the pH to 9.0 every 5° C. in a similar manner, the temperature is raised up to 90° C. at a temperature increase rate of 1° C./min and holding is performed for 3 hours at 90° C. When the particle shape and the surface texture are observed every 15 minutes by an optical microscope and an electron scanning microscope (FE-SEM), the unification in particles is confirmed when 1.0 hour has passed. Therefore, the container is cooled up to 30° C. for 5 minutes by cooling water.

After that, 1.5 parts of colloidal silica (manufactured by Aerosil Co. Ltd.: R972) are added with respect to 100 parts of the particle and stirred by a Henschel mixer at a peripheral speed of 33 m/s for 3 minutes to prepare a toner 1.

<Method of Manufacturing Electrostatic Latent Image Developer 1>

[Preparation of Carrier 1]

Ferrite Particles (volume average particle size: 35 μm, GSDv: 1.20): 100 parts

Toluene: 14 parts

Polymethyl Methacrylate-Perfluorooctyl Methyl Acrylate Copolymer (copolymerization ratio: 70/30, critical surface tension: 24 dyn/cm): 1.6 parts Carbon Black (product name: VXC-72, manufactured by Cabot Corporation, volume resistivity: 100 Ωcm or less): 0.12 part Crosslinked Melamine Resin Particles (average particle size: 0.3 μm, toluene-insoluble) 0.3 part First, carbon black is diluted with toluene and added to the polymethyl methacrylate-perfluorooctyl methyl acrylate copolymer. Then, the dispersion is performed using a sand mill. Next, the above components other than the ferrite particles are dispersed by a stirrer for 10 minutes to prepare a coating layer forming liquid. Next, the coating layer forming liquid and the ferrite particles are put into a vacuum deaeration-type kneader and stirred for 30 minutes at a temperature of 60° C., and then the pressure is reduced to distil away the toluene, whereby a resin coating layer is formed and a carrier is obtained.

[Preparation of Electrostatic Latent Image Developer 1]

40 parts by weight of the toner is added to 500 parts by weight of the resin-coated carrier and blended for 20 minutes by a V-shaped blender. Then, the aggregates are removed by a 212 μm-opening vibration sieve to prepare a developer.

<Image Forming Method>

Using Apeos Port-II 04300 (manufactured by Fuji Xerox Co., Ltd), 10 single color images of the test chart No. 1-R 1993 of the Society of Electrophotography of Japan are prepared by black, cyan, magenta and yellow developers, respectively. C2 paper (manufactured by Fuji Xerox Co., Ltd) is used as a sheet.

Next, using a modified Apeos Port-II 04300 (that may perform the output even without a fixing machine and operates even when all of developing machines are not gathered together), an image in which the toner 1 is not fixed so that a solid image is prepared on an alphabet portion of the single color test chart prepared in the above description is prepared with the electrostatic latent image developer 1 put into a developing machine. Thereafter, the image is fixed by an external fixing machine. The fixing conditions are as follows. The contact width of a fixing region is 6 mm, the contact time is 0.1 seconds, the set temperature of the fixing machine is 130° C., and the surface pressure is 0.75 kgf/cm$^2$.

In addition, the toner 1 applied amount is 20 g/m$^2$.

The obtained images are evaluated as follows.

<Visibility (Peelability) of Image of Base>

The respective single color images of the solid portion prepared using the toner 1 of the fixed image of four colors, that is, total 4 images are scratched by a 1-yen coin to peel the toner of the solid portion. Sensory evaluation on the visibility of the cyan, magenta, yellow and black images that are the base is performed with the following evaluation standards. From G2 or higher levels are in the acceptable range.

G8: Even the smallest letter may be read in the prepared images of four colors.

G7: It is difficult to read the smallest letter in the yellow image.

G6: It is difficult to read the smallest letter in the yellow and magenta image.

G5: It is difficult to read the smallest letter in the images other than the black image.

G4: It is difficult to read the smallest letter in the prepared four color images.

G3: It is difficult to read the second smallest letter in one of the prepared four color images.

G2: It is difficult to read the second smallest letter in two or three of the prepared four color images.

G1: It is difficult to read the second smallest letter in the prepared four color images.

That is, the peelability of the prepared solid image shows that when the peelability is poor, even the letters of the base are damaged and may not be read.

<Concealing Ability>

Sensory evaluation on the concealing ability is performed with the following evaluation standards by using the image before the peeling for visibility of the image of the base. From G2 or higher levels are in the acceptable range.

G8: All of the letters in the prepared 40 images of four colors are concealed and may not be read.

G7: The letter in one of the prepared 40 images of four colors may be read through the solid portion.

G6: The letter in two of the prepared 40 images of four colors may be read through the solid portion.

G5: The letter in three of the prepared 40 images of four colors may be read through the solid portion.

G4: The letter in four of the prepared 40 images of four colors may be read through the solid portion.

G3: The letter in five to eight of the prepared 40 images of four colors may be read through the solid portion.

G2: The letter in nine to ten of the prepared 40 images of four colors may be read through the solid portion.

G1: The letter in eleven or more of the prepared 40 images of four colors may be read through the solid portion.

In the above-described test chart, 9 different sizes of alphabet letters are described, and the solid portion is prepared so as to cover all of the 9 kinds of alphabet letters. In the concealing ability evaluation, even when only one letter is read among the 9 kinds of letters, it may be regarded as readable.

Examples 2 to 27, Comparative Examples 1 to 5

Electrostatic latent image developing toners and electrostatic latent image developers are prepared in a manner similar to the case of Example 1, except that the used binder resin is changed as described in Table 3.

The evaluation results are shown in the following Table 3.

TABLE 3

| | | PES | | SBR | | Toner | | Evaluation | |
|---|---|---|---|---|---|---|---|---|---|
| | Amount of Pigment in Toner (wt %) | Kind | Mixed Amount in Binder Resin (wt %) | Kind | Mixed Amount in Binder Resin (wt %) | Tg (° C.) | Young's Modulus (MPa) | Concealing Property | Peel ability |
| Example1 | 30 | PES1 | 35 | SBR1 | 65 | −14 | $10^{1.38}$ | G8 | G8 |
| Example2 | 30 | PES1 | 38 | SBR1 | 62 | −11 | $10^{1.45}$ | G8 | G8 |
| Example3 | 30 | PES1 | 22 | SBR1 | 78 | −28 | $10^{1.05}$ | G6 | G8 |
| Example4 | 30 | PES1 | 42 | SBR1 | 58 | −7 | $10^{1.55}$ | G8 | G7 |
| Example5 | 30 | PES1 | 18 | SBR1 | 82 | −33 | $10^{0.95}$ | G5 | G8 |
| Example6 | 30 | PES1 | 48 | SBR1 | 52 | −1 | $10^{1.70}$ | G7 | G6 |
| Example7 | 30 | PES1 | 12 | SBR1 | 88 | −39 | $10^{0.80}$ | G5 | G8 |
| Example8 | 30 | PES1 | 52 | SBR5 | 48 | 1 | $10^{1.80}$ | G8 | G4 |
| Example9 | 30 | PES1 | 8 | SBR1 | 92 | −43 | $10^{0.70}$ | G4 | G8 |
| Example10 | 30 | PES2 | 59 | SBR1 | 41 | 2 | $10^{1.09}$ | G7 | G4 |
| Example11 | 30 | PES1 | 6 | SBR1 | 94 | −46 | $10^{0.65}$ | G4 | G8 |
| Example12 | 30 | PES2 | 63 | SBR1 | 37 | 2 | $10^{2.08}$ | G8 | G3 |
| Example13 | 30 | PES1 | 3 | SBR1 | 97 | −49 | $10^{0.58}$ | G3 | G8 |
| Example14 | 21 | PES1 | 35 | SBR1 | 65 | −14 | $10^{1.28}$ | G8 | G8 |
| Example15 | 38 | PES1 | 35 | SBR1 | 65 | −14 | $10^{1.46}$ | G8 | G8 |
| Example16 | 18 | PES1 | 35 | SBR1 | 65 | −14 | $10^{1.25}$ | G7 | G8 |
| Example17 | 42 | PES1 | 35 | SBR1 | 65 | −14 | $10^{1.50}$ | G8 | G7 |
| Example18 | 11 | PES1 | 35 | SBR1 | 65 | −14 | $10^{1.17}$ | G5 | G8 |
| Example19 | 48 | PES1 | 35 | SBR1 | 65 | −14 | $10^{1.57}$ | G8 | G5 |
| Example20 | 30 | PES3 | 10 | SBR5 | 90 | −52 | $10^{0.61}$ | G3 | G8 |
| Example21 | 30 | PES3 | 3 | SBR5 | 97 | −58 | $10^{0.58}$ | G2 | G8 |
| Example22 | 30 | PES1 | 45 | SBR3 | 55 | 8 | $10^{2.70}$ | G8 | G3 |
| Example23 | 30 | PES1 | 50 | SBR2 | 50 | 11 | $10^{2.80}$ | G8 | G2 |
| Example24 | 30 | PES1 | 45 | SBR2 | 55 | 19 | $10^{2.90}$ | G8 | G2 |
| Example25 | 30 | PES4 | 35 | SBR2 | 65 | −1 | $10^{2.45}$ | G8 | G5 |
| Example26 | 30 | PES1 | 35 | SBR4 | 65 | 6 | $10^{2.95}$ | G8 | G3 |
| Example27 | 30 | PES1 | 35 | SBR1 | 65 | −14 | $10^{1.28}$ | G8 | G4 |

TABLE 3-continued

| | Amount of Pigment in Toner (wt %) | PES Kind | PES Mixed Amount in Binder Resin (wt %) | SBR Kind | SBR Mixed Amount in Binder Resin (wt %) | Toner Tg (° C.) | Toner Young's Modulus (MPa) | Evaluation Concealing Property | Evaluation Peel ability |
|---|---|---|---|---|---|---|---|---|---|
| Comparative example1 | 8 | PES1 | 35 | SBR1 | 65 | −14 | $10^{1.14}$ | G1 | G8 |
| Comparative example2 | 52 | PES1 | 35 | SBR1 | 65 | −14 | $10^{1.61}$ | G8 | G1 |
| Comparative example3 | 30 | — | 0 | SBR5 | 100 | −61 | $10^{0.48}$ | G1 | G8 |
| Comparative example4 | 30 | PES4 | 60 | SBR2 | 40 | 25 | $10^{2.90}$ | G8 | G1 |
| Comparative example5 | 30 | PES4 | 35 | SBR4 | 65 | 9 | $10^{3.20}$ | G8 | G1 |

The pigment dispersion 2 is used only in the case of Example 27.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic latent image developing toner comprising:

a release agent;

a pigment; and a binder resin, wherein the content of the pigment is from 10% by weight to 50% by weight, a glass transition temperature (Tg) of the toner is in the range of from −60° C. to 20° C., and a Young's modulus of the toner at 20° C. is in the range of from $1\times10^{0}$ MPa to $1\times10^{3}$ MPa.

2. The electrostatic latent image developing toner according to claim 1, wherein the binder resin contains a conjugated diene polymer from 40% by weight to 95% by weight with respect to the entire binder resin.

3. The electrostatic latent image developing toner according to claim 2, wherein a glass transition temperature (Tg) of the conjugated diene polymer is in the range of from −65° C. to −10° C., and a Young's modulus of the conjugated diene polymer at 20° C. is in the range of from $10^{-1}$ MPa to $10^{3}$ MPa.

4. The electrostatic latent image developing toner according to claim 2, wherein the conjugated diene polymer is a styrene-butadiene copolymer.

5. The electrostatic latent image developing toner according to claim 1, wherein the binder resin contains a polyester resin from 5% by weight to 60% by weight of the entire binder resin.

6. The electrostatic latent image developing toner according to claim 5, wherein a glass transition temperature (Tg) of the polyester resin is in the range of from 15° C. to 70° C., and Young's modulus of the polyester resin at 20° C. is in the range of from $10^{0.4}$ MPa to $10^{3.7}$ MPa.

7. The electrostatic latent image developing toner according to claim 1, wherein the pigment is an aluminum powder.

8. The electrostatic latent image developing toner according to claim 1, wherein the pigment content in the electrostatic latent image developing toner is in the range of from 20% by mass to 40% by mass with respect to the entire toner.

9. A developer for developing an electrostatic latent image, comprising:

the electrostatic latent image developing toner according to claim 1.

10. The electrostatic latent image developing toner according to claim 1, wherein the toner, when used, is able to form a peelable concealing layer.

11. The electrostatic latent image developing toner according to claim 1, wherein the binder resin includes an elastomer having a glass transition temperature (Tg) from −65° C. to −10° C. and a Young's modulus at 20° C. from $10^{-1}$ MPa to $10^{3}$ MPa.

12. An image forming method comprising:

charging a surface of an image holding member;

forming an electrostatic latent image on the surface of the image holding member;

developing the electrostatic latent image formed on the surface of the image holding member by using a developer to form a toner image; and transferring the developed toner image onto a transfer medium, wherein the developer is the developer for developing the electrostatic latent image according to claim 9.

13. The image forming method according to claim 12, wherein the binder resin of the electrostatic latent image developing toner contains a conjugated diene polymer from 40% by weight to 95% by weight with respect to the entire binder resin.

14. The image forming method according to claim 13, wherein a glass transition temperature (Tg) of the conjugated diene polymer of the electrostatic latent image developing toner is in the range of from −65° C. to −10° C., and a Young's modulus of the conjugated diene polymer at 20° C. is in the range of from $10^{-1}$ MPa to $10^{3}$ MPa.

* * * * *